US010921092B2

(12) United States Patent
Libotte et al.

(10) Patent No.: US 10,921,092 B2
(45) Date of Patent: Feb. 16, 2021

(54) VIEWFINDER WITH MOBILE RED DOT AND ILLUMINATOR

(71) Applicant: FN Herstal S.A., Herstal (BE)

(72) Inventors: Hugues Libotte, Jalhay (BE); Kristof Verjans, Tongeren (BE)

(73) Assignee: FN Herstal S.A., Herstal (BE)

( * ) Notice: Subject to any disclaimer, the term of this patent is extended or adjusted under 35 U.S.C. 154(b) by 218 days.

(21) Appl. No.: 16/317,278

(22) PCT Filed: Jul. 11, 2017

(86) PCT No.: PCT/EP2017/067429
§ 371 (c)(1),
(2) Date: Jan. 11, 2019

(87) PCT Pub. No.: WO2018/011219
PCT Pub. Date: Jan. 18, 2018

(65) Prior Publication Data

US 2020/0386516 A1 Dec. 10, 2020

(30) Foreign Application Priority Data

Jul. 15, 2016 (BE) ..... 2016/5594

(51) Int. Cl.
*F41G 1/30* (2006.01)
*F41G 1/35* (2006.01)
(Continued)

(52) U.S. Cl.
CPC ..... *F41G 1/30* (2013.01); *F41G 1/35* (2013.01); *F41G 1/38* (2013.01); *F41G 3/145* (2013.01); *F41G 1/48* (2013.01)

(58) Field of Classification Search
CPC ..... F41G 1/30; F41G 1/35; F41G 1/38; F41G 3/145
See application file for complete search history.

(56) References Cited

U.S. PATENT DOCUMENTS 5,205,044 A * 4/1993 DePaoli ..... G02B 23/14 42/132
5,452,131 A * 9/1995 Jorlov ..... F41G 1/345 356/247
(Continued)

FOREIGN PATENT DOCUMENTS

DE 102013109281 A1 11/2013
EP 0385079 A2 1/1990
(Continued)

OTHER PUBLICATIONS

Written Opinion of the International Searching Authority, Application PCT/EP2017/067429, dated Jan. 15, 2019 (Year: 2019).*
(Continued)

*Primary Examiner* — Joshua T Semick
(74) *Attorney, Agent, or Firm* — Leydig, Voit & Mayer, Ltd.; Gerald T. Gray

(57) ABSTRACT

A viewfinder with a mobile red dot comprising a first stationary light source and a first reflective strip, the light source generating a first collimated light beam which is projected onto the reflective strip so as to materialize a red dot or grid visible for the shooter by the reflection on the reflective strip, the first beam being projected onto the reflective strip by means of a rotary mirror with adjustable angle of inclination relative to the first light beam.

13 Claims, 2 Drawing Sheets

(51) Int. Cl.

| | |
|---|---|
| ***F41G 1/48*** | (2006.01) |
| ***F41G 1/38*** | (2006.01) |
| ***F41G 3/14*** | (2006.01) |

(56) References Cited

U.S. PATENT DOCUMENTS

| | | | | |
|---|---|---|---|---|
| 7,069,685 | B2 * | 7/2006 | Houde-Walter | F41C 27/00 42/113 |
| 7,997,022 | B2 * | 8/2011 | Morin | F41G 1/14 42/114 |
| 8,578,646 | B2 * | 11/2013 | Joannes | F41G 1/30 42/113 |
| 9,057,583 | B2 * | 6/2015 | Matthews | G02B 7/004 |
| 9,200,869 | B2 | 12/2015 | Yang et al. | |
| 9,383,168 | B2 * | 7/2016 | Stokes | F41G 3/06 |
| 10,495,413 | B2 * | 12/2019 | Houde-Walter | F41G 3/145 |
| 2006/0234191 | A1 * | 10/2006 | Ludman | F41H 13/0056 434/11 |
| 2015/0068098 | A1 | 3/2015 | Stokes et al. | |
| 2016/0169621 | A1 | 6/2016 | Geva et al. | |

FOREIGN PATENT DOCUMENTS

| | | | |
|---|---|---|---|
| EP | 1818645 | A1 | 1/2007 |
| FR | 2326715 | A1 | 10/1975 |
| FR | 2506921 | A1 | 6/1981 |

OTHER PUBLICATIONS

International Search Report in International Application No. PCT/EP2017/067429 dated Nov. 7, 2017.

* cited by examiner

VIEWFINDER WITH MOBILE RED DOT AND ILLUMINATOR

FIELD OF THE INVENTION

The present invention relates to a targeting system for firearms for munitions having a parabolic trajectory.

PRIOR ART

It is known from document EP 1 818 645 to superpose on a target a red dot that is movable to a target in order to improve the targeting of a parabolic shot. By parabolic shot, what is meant here is a ballistic shot for which the difference between the direct angle of sight and the angle of elevation of the weapon correcting for the effect of gravity is large, in particular, in excess of 5 to 10°. Document EP 2 221 571 proposes a similar solution in which a two-prism beamsplitter plays the role of reflective surface for steering the image of the red dot to the desired position. In these two documents, elevation is set by rotating a movable mirror.

It is sometimes necessary, besides superposition of a movable red dot, to designate or illuminate the target. These two documents have nothing to say on this subject.

AIMS OF THE INVENTION

A first aspect of the invention aims to provide a targeting system combining illumination and movable red dot into a single synchronous device.

A second aspect of the invention aims to provide a targeting system allowing the user to correct for azimuthal drift of a munition due to the Magnus effect.

SUMMARY OF THE INVENTION

The present invention relates to a movable red dot sight comprising a first fixed light source and a first reflective plate, the light source generating a first collimated light beam that is projected onto the reflective plate in order to materialize a red dot or reticle that is visible to the shooter in reflection from the reflective plate and the first beam being projected onto the reflective plate by way of a rotatable mirror the angle of inclination of which with respect to the first light beam is adjustable.

By parabolic shot, what is meant in the present description is a shot for which the difference between the angle of elevation of the target and the angle of elevation for the shot is larger than 10°.

According to preferred embodiments of the invention, the movable red dot sight of the invention includes at least one, or a suitable combination, of the following features:

- the sight comprises an illuminator/designator in which said sight comprises a second fixed light source that generates a second collimated light beam that is initially parallel to the first light beam and that is steered by said rotatable mirror toward a second reflective plate placed at an angle of 90° to the first reflective plate in order to illuminate/designate a target;
- the first and/or second reflective plate is a semi-transparent plate beamsplitter;
- the sight comprises a device for adjusting the angle of inclination of the rotatable mirror with respect to the light beams, allowing the angle of the mirror to be adjusted depending on the distance of the target and/or the type of munition;

- the adjusting device is equipped with a graduation representing the distance of the target;
- the adjusting device is equipped with a plurality of graduations specific to different types of munition;
- the adjusting device comprises a motor or mechanical actuator for adjusting the angle of the rotatable mirror and a ballistic computer that controls said motor/actuator and that allows the required mirror angle to be calculated and instigated depending on the distance of the target and on the type of munition used;
- the ballistic computer is equipped with a rangefinder that automatically communicates thereto the distance of the target when the shooter triggers the measurement;
- the first and/or second light source comprises a collimator with a convergent lens and a light source placed at the focal point of the lens of the collimator;
- the diameter of the generated light beam is small, preferably about 15 mm or smaller;
- the light source of the beam of the red dot is point-like, preferably with a diameter of about one tenth of a millimeter or of about one millimeter;
- the light source of the red dot is formed by an LED placed behind a mask that is located at the focal point of the lens of the collimator and that is drilled with a hole in the location of the optical axis of the generated light beam;
- the lateral position of the reticle is automatically moved laterally by a device controlled by the ballistic computer depending on the type of munition used and the distance of the target, so as to correct for the deviation in the trajectory of the munition due to the Magnus effect;
- the sight comprises a ballistic computer equipped with an inclinometer that measures the cant of the weapon, the computer determining the cant of the weapon that corrects for the Magnus effect, indications in the sight indicating when this inclination is achieved.

REFERENCE NUMBERS USED IN THE FIGURES

Figure 1:
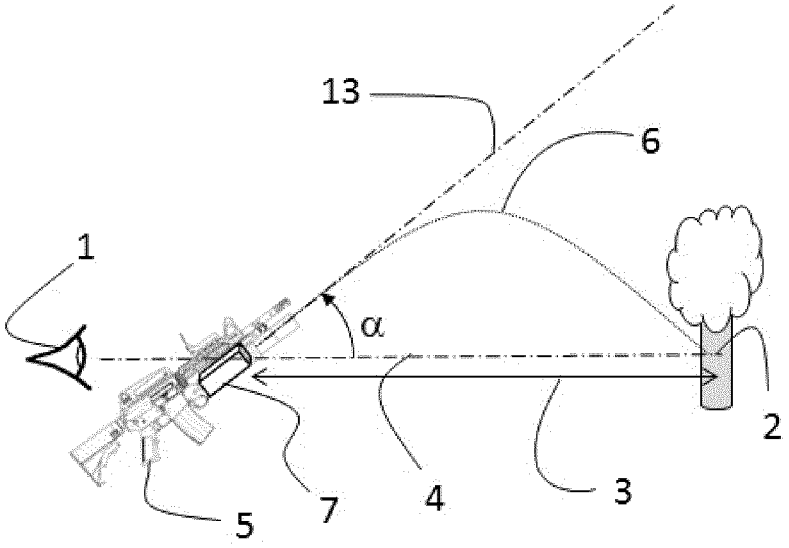
FIG. 1 shows the general parameters of a parabolic shot.
Figure 2:
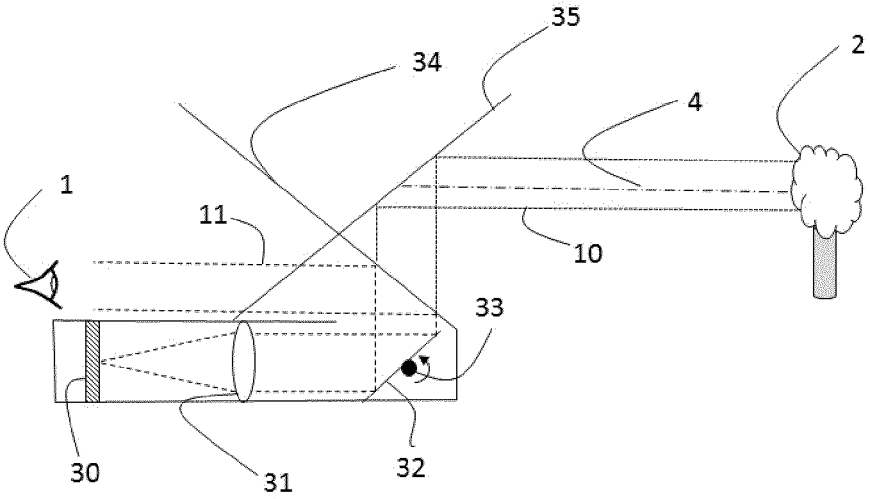
FIGS. 2 and 3 show a side view of a targeting system according to the invention.
Figure 3:
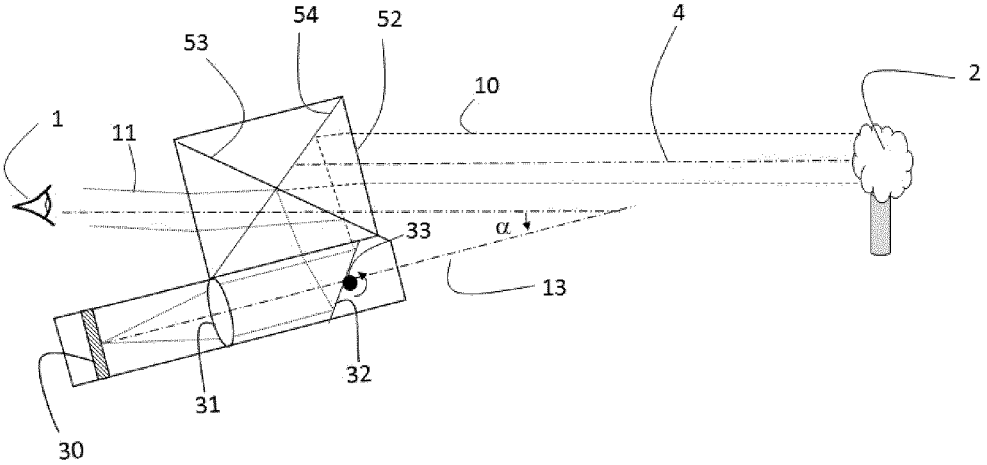
Figure 4:
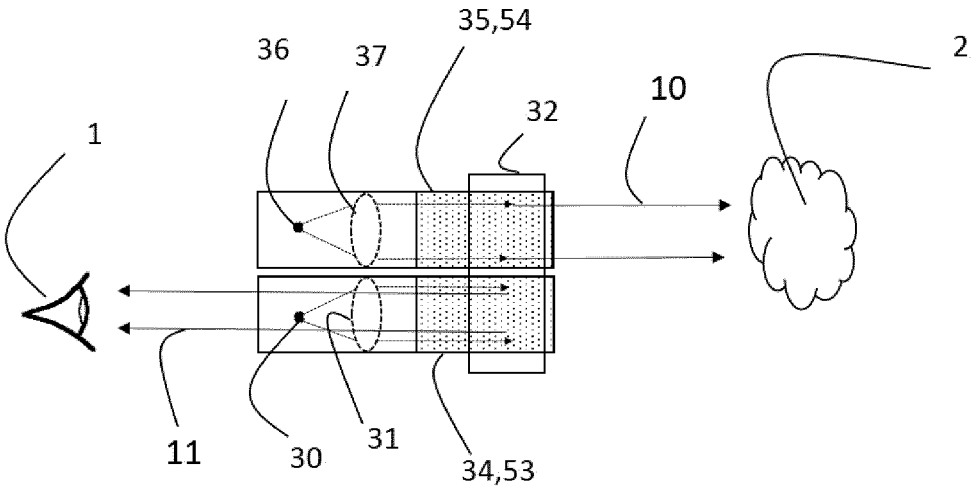
FIG. 4 shows a top view of a targeting system according to the invention.

1. User
2. Target
3. Shooting distance
4. Axis of sight
5. Weapon
6. Trajectory
7. Sighting scope
10. Illuminating light beam
11. Light beam of the red dot
12. Reticle or red dot
13. Bore axis
20. Indicator of actual inclination
21. Visual inclination objective indicators
30. Red dot (reticle) light source
31. Collimating device (lens)
32. Movable mirror

33. Axis of rotation of the movable mirror
34. Semi-reflective plate for steering the red dot
35. (Semi-)reflective plate for steering the designating/illuminating beam
36. Designating/illuminating light source
51, 52. Beamsplitter cubes
53, 54. Reflective surfaces of the beamsplitter cubes

DETAILED DESCRIPTION OF THE INVENTION

The idea behind the invention consists in using one and the same movable part to define, on the one hand, the position of a movable red dot, and on the other hand, the angle between an illuminating/designating beam and the bore axis of the weapon.

This system comprises two separate sources 30, 36 that illuminate the same reflective movable plane 32 (mirror). These two separate sources are collimated and/or focused by optical means 31, 37 and the obtained beams are parallel to each other. These two sources are vertically fixed.

The light source 30 that serves for the movable red dot is steered by the movable mirror 32 toward a first semi-reflective surface 34, 53 that steers it toward the eye of the user 1. The semi-reflective surface then allows the movable red dot to be superposed on the target. The angle at which this red dot is seen is adjusted via the position of the movable mirror 32.

The light source 30 that serves for the movable red dot is a point-like source of low brightness. It may for example form part of a screen of good resolution, so as to allow other information to be displayed.

The light source 36 that serves for the illumination is steered by the same movable mirror 32 toward a second reflective surface 35, 54 that is perpendicular to the first, which steers it toward the target 2. The angle at which the illuminating beam is then emitted is parallel to the beam of the movable red dot, but, oriented at 180°. This second reflective surface may optionally be semi-reflective. Specifically, it may be sufficiently offset laterally in order not to obstruct the field of view of the user. Nevertheless, in order not to obstruct the field of view of the user, this surface is, preferably, semi-reflective.

The steering angle of the movable mirror may for example be modified by a piezoelectric, electromagnetic or electrical actuator, or any other suitable means.

The illuminating source is sufficiently bright to illuminate a distant target. It may furthermore have a wavelength outside of the visible, for example in the case of use of a night-vision device (IR).

So as to obtain beams of plane waves (collimated or parallel beam) the light sources are, for example, placed in the focal plane of an optical system 31, 37. In the case of certain types of laser pointers, the laser beam is already collimated and no additional optics are required.

Such as described in document EP 2 221 571, which is incorporated herein by reference, the fixed mirrors, or one thereof, may advantageously be replaced by prisms. In this case, specifically, refraction induces a decrease in the movement of the light beams over the reflective surfaces 53, 54, this allowing the length thereof, and therefore the bulk of the system, to be decreased. These prisms are preferably integrated into two beamsplitter cubes 51, 52 allowing the image of the target to be superposed on the reticle.

Lastly, when the Magnus effect is to be taken into consideration, the luminous red dot and the designating beam may advantageously be moved to correct the azimuthal direction by moving the corresponding light sources laterally in their respective focal planes. This movement may either be obtained by an actuator or by lateral movement of the reticle over a screen.

Another way of taking into account the Magnus effect is to take advantage of the azimuthal error introduced by a non-zero cant. Advantageously, the sighting scope of the invention then comprises an inclinometer that measures the cant of the weapon and an optical display projected from the focal plane of the lens 31 of the red dot. In this case, the light source of the red dot advantageously comprises a screen of good resolution, allowing both inclination (cant) information and the red dot to be displayed.

Preferably, depending on the distance of the target, a cant correcting for the Magnus effect is determined, the optical display indicating to the user when this cant is achieved. For example, the reticle may flash when the cant is achieved.

Figure 5:
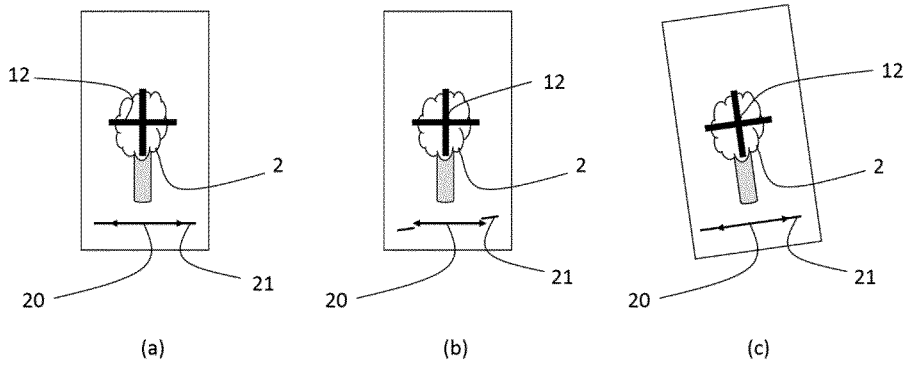
FIG. 5 shows an example of a display of a targeting system according to the invention.

FIG. 5 shows a display comprising cant indications. In this figure, visual indicators 21 define the ideal angle, and a straight-line segment 20 indicates the actual inclination of the weapon. FIG. 5(*a*) shows the situation in which a cant of zero is sought, for example in the case where the azimuthal correction is obtained by moving the reticle. FIG. 5(*b*) shows the situation in which the visual indicators have been inclined to inform the shooter that he must incline the weapon to correct for the Magnus effect. In FIG. 5(*c*), the inclination has been corrected and the weapon is in firing position (i.e. the inclination indicator 20 is aligned with the visual indicators 21). This aspect of the invention may be used in combination with the simultaneous use of an illuminator, or independently thereof.

The invention claimed is:

1. A movable red dot sight comprising a first fixed light source and a first reflective plate, the first fixed light source generating a first collimated light beam that is projected onto the first reflective plate in order to materialize a reticle or red dot that is visible to a shooter of the weapon in reflection from the first reflective plate and the first collimated light beam being projected onto the first reflective plate by way of a rotatable mirror the angle of inclination of which with respect to the first collimated light beam is adjustable, wherein said movable red dot sight further comprises a second fixed light source that generates a second collimated light beam that is initially parallel to the first collimated light beam and that is steered by said rotatable mirror toward a second reflective plate placed at an angle of 90° to the first reflective plate in order to illuminate/designate a target.

2. The movable red dot sight as claimed in claim 1, wherein the first and/or second reflective plate includes a semi-transparent plate beamsplitter.

3. The movable red dot sight as claimed in claim 1, further comprising a device for adjusting an angle of inclination of the rotatable mirror with respect to the first and second collimated light beams, allowing the angle of inclination of the rotatable mirror to be adjusted depending on a distance of the target and/or a type of munition.

4. The movable red dot sight as claimed in claim 3, wherein the device for adjusting is equipped with a graduation representing the distance of the target.

5. The movable red dot sight as claimed in claim 4, wherein the device for adjusting is equipped with a plurality of graduations specific to different types of munition.

6. The movable red dot sight as claimed in claim 3, wherein the device for adjusting device comprises a motor or mechanical actuator for adjusting the angle of inclination of the rotatable mirror and a ballistic computer that controls said motor or actuator and enables a required mirror angle to be calculated and instigated depending on the distance of the target and on the type of munition.

7. The movable red dot sight as claimed in claim 6, wherein the ballistic computer is equipped with a rangefinder that automatically communicates thereto the distance of the target when the shooter triggers a measurement.

8. The movable red dot sight as claimed claim 1, wherein the first and/or second fixed light source comprises a collimator with a convergent lens and a light source placed at the focal point of the convergent lens.

9. The movable red dot sight as claimed in claim 1, wherein the red dot or reticle is point-like, with a diameter of about one tenth of a millimeter to about one millimeter.

10. The movable red dot sight as claimed in claim 8 wherein the first fixed light source includes a light emitting diode (LED) located behind a mask that is located at the focal point of the convergent lens and that is drilled with a hole in the location of an optical axis of the first collimated light beam.

11. The movable red dot sight as claimed in claim 6, wherein a lateral position of the reticle is automatically moved laterally by a device controlled by the ballistic computer depending on a type of munition used and a distance of a target, so as to correct for a deviation in a trajectory of the munition used due to the Magnus effect.

12. The movable red dot sight as claimed in claim 1, further comprising a ballistic computer equipped with an inclinometer that measures a cant of an attached weapon, the ballistic computer determining an inclination of the attached weapon that corrects for the Magnus effect, indications in the sight indicating when said inclination is achieved.

13. The movable red dot sight as claimed in claim 1, wherein the second collimated light beam has one of a visible wavelength or an infrared wavelength.

* * * * *